US005876153A

United States Patent [19]

Krings

[11] Patent Number: 5,876,153

[45] Date of Patent: Mar. 2, 1999

[54] TRENCH FALSEWORK PANEL

[75] Inventor: Josef Krings, Heinsberg, Germany

[73] Assignee: Wolfgang Richter, Hurtgenwald, Germany

[21] Appl. No.: 793,979

[22] PCT Filed: Aug. 4, 1995

[86] PCT No.: PCT/DE95/01047

§ 371 Date: May 23, 1997

§ 102(e) Date: May 23, 1997

[87] PCT Pub. No.: WO96/08610

PCT Pub. Date: Mar. 21, 1996

[30] Foreign Application Priority Data

Sep. 12, 1994 [DE] Germany ..... 44 32 465

[51] Int. Cl.[6] ..... E02D 17/08

[52] U.S. Cl. ..... 405/282; 405/272; 405/283

[58] Field of Search ..... 405/272, 274, 405/282, 283, 275, 276

[56] References Cited

U.S. PATENT DOCUMENTS

| | | | |
|---|---|---|---|
| 2,865,178 | 12/1958 | Wicke | 405/283 |
| 3,230,720 | 1/1966 | Bennett | 405/282 |
| 3,766,740 | 10/1973 | Teegen | 405/282 |
| 4,002,035 | 1/1977 | Wright | 405/283 |
| 5,180,256 | 1/1993 | Krings | 405/282 |
| 5,336,023 | 8/1994 | Burdine | 405/283 |
| 5,669,738 | 9/1997 | Kundel | 405/283 |

*Primary Examiner*—Tamara L. Graysay
*Assistant Examiner*—Frederick L. Lagman
*Attorney, Agent, or Firm*—Kennedy, Covington, Lobdell & Hickman, LLP

[57] ABSTRACT

A lining plate intended for employment in connection with trench lining in below-grade construction becomes assembly- and removal-friendly and simultaneously resistant to flexural buckling even against forces acting during driving in by means of the excavator bucket, if a hollow profile plate structure, which forms the plate frame and is welded together with the remaining plate part, is provided, and if at least one suspension eye is cut into the plate surface a distance apart from the circumferential hollow profile frame elements, which contains a fastening means for a lifting means of the crane.

16 Claims, 3 Drawing Sheets

TRENCH FALSEWORK PANEL

Figure 3:
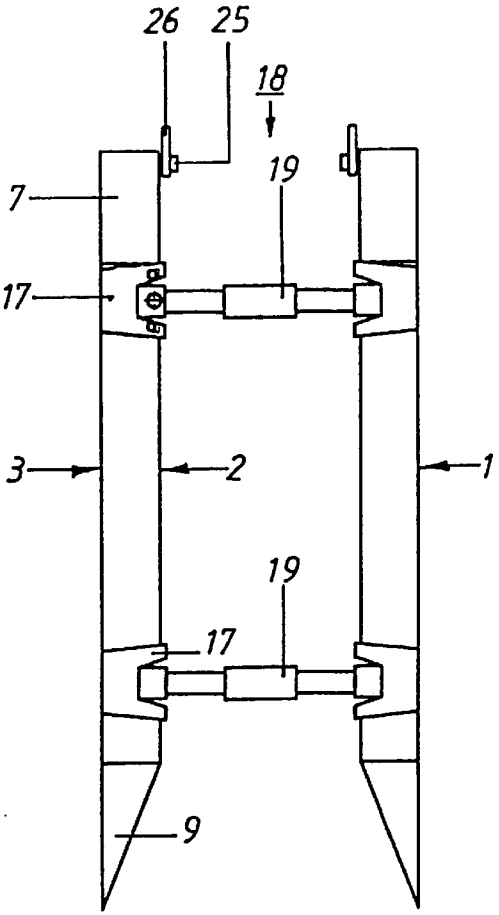

The invention relates to a lining plate, consisting of profiled sheet metal elements enclosed between two rectangular sheet metal covers and hollow profiles welded together with the sheet metal covers, preferably as a frame structure made of circumferentially closed hollow profiles, for use in connection with trench lining in below-grade construction.

A lining plate with a circumferential hollow profile is described in DE 30 15 110 A1. This lining plate, also provided for shoring up trench walls, has exterior sheet metal plates essentially extending over the entire plate surface, a rectangular frame supporting the edges of the exterior sheet metal plates, and profiles which reinforce the frame and intersect each other. Together with the exterior sheet metal plates, the frame profiles constitute closed hollow box profiles, i.e. a hollow profile frame delimiting the plate body. In detail, the latter can consist of an upper anvil cross piece (pressure cross beam), on which pressure or blows are directed during operation; of lateral closing profiles (vertical cross beams) which can have a rectangular cross section, the same as the anvil profiles; and of a lower pointed or cutting profile of triangular cross section.

In order to be able to direct such lining plates during installation or removal, for example in the course of the assembly of a lining box or in the course of insertion into the trench during slide rail lining or box lining, fastening points are required, on which a crane hook, cable or the like is intended to be securely fastened in order to prevent accidents (for example because of dropping plates). In the known case the eyes disrupt the anvil cross bar. The frame structure is weakened by this. The entire plate, whose upper edge is often pounded by the excavator bucket during operation for the purpose of driving it in, therefore has a tendency toward flexural buckling in the area of the eyes in particular.

US-A-35 93 528 describes a lining plate for employment in connection with the trench lining in below-grade construction, consisting of a reinforced rectangular sheet metal cover and circumferential hollow profiles welded together with the sheet metal cover. Lifting eyes are located at the four inner corners of the lining plate. These are welded to the hollow profiles. Thus, these are brackets with a suspension eye attached to the outside of the lining plates adjacent to their circumferential hollow profiles. Elements welded on in this way are easily bent in the course of the rough work at the construction site, so that they can no longer be grasped by a crane hook.

In the course of assembling a lining box of two lining plates, generally the one lining plate is placed on the ground, then braces (these are spacers between lining plates standing opposite each other in the trench) are fastened in the plate resting on the ground, the second plate is then lifted over the first plate by a crane and the braces are inserted from below into the second plate and fastened there. During this operation it is necessary for the second plate to be accurately directed by the crane and securely held, so that no accidents can occur. To this end, in actual operations the exterior narrow sides of the two lateral closing profiles of the plate are pulled forward as "free" triangular sheet metal brackets up to approximately the tip of the cutting edge of the lower profile and are equipped with a suspension hole. During horizontal directing the crane can act on the two triangular brackets and on the eyes of further attachment points associated with the upper plate edge, i.e. at four points.

The drilled brackets provided laterally at the longitudinal ends of the cutting edge are generally bent after a short period of use, or even broken off. In actual use the lining plate is therefore held at the cutting edge during assembly in that the crane hooks are simply placed over the cutting edge—without a particular attachment point—. Then there is always the danger that one or the other hook slides to the side when the plate is lifted, so that the entire plate begins to tilt.

However, the attachment points for a crane to act on are not only needed during assembly, but also during insertion into the trench, during pulling through the trench or during removal. In any case, it is necessary to prevent a lining plate or a lining box formed from it to slip off the crane during insertion into the trench or removal from the trench.

It is the object of the invention to create a lining box which as a whole is resistant to buckling and on the upper edge in particular is resistant to flexural buckling by the forces acting on it when driving it in with the excavator, which is both assembly- and removal-friendly, and which has attachment points which do not impair the rigidity of the hollow profile frame and still ensure a secure grip for crane action.

The attainment of the object in accordance with the invention is disclosed in claim 1. Improvements and further embodiments of the invention are described in the dependent claims.

In accordance with the invention at least one suspension eye, which can be gripped by lifting means of the crane, is cut into the plate surface enclosed at a distance by circumferential hollow profiles of the lining plate mentioned at the outset and contains a fastening means as the attachment point for the lifting means of the crane. Fastening means are understood to be immovably or movably, for example rotatably seated eyes, hooks, bolts or the like, which are suitable for receiving a crane hook, a cable or like lifting means securely fixed in place, even though the suspension eye is located so far away from the plate edge that the crane hook, for example, cannot engage the suspension eye over the plate edge. The suspension eyes are preferably integrated into the plate surface at a distance away from the adjoining parts of the hollow profiles. However, the suspension eyes basically can adjoin the hollow profile elements directly touching them.

In a further development of the invention, the suspension eye can be designed as an opening penetrating the lining plate, or it can extend on one side up to the inner wall of the lining plate. In the latter case it is possible for a second suspension eye to be congruently placed on the side of the lining plate opposite the suspension eye. However, the oppositely located eyes can also be arranged in the plate surface independently of each other—always at a distance apart from the hollow profiles—.

An attachment point in the lining plate, which can be engaged and securely held by the lifting means of the crane, is like lifting means securely fixed in place, even though the suspension eye is located so far away from the plate edge that the crane hook, for example, cannot engage the suspension eye over the plate edge. The suspension eyes are preferably integrated into the plate surface at a distance away from the adjoining parts of the hollow profiles. However, the suspension eyes basically can adjoin the hollow profile elements directly touching them.

In a further development of the invention, the suspension eye can be designed as an opening penetrating the lining plate, or it can extend on one side up to the inner wall of the lining plate. In the latter case it is possible for a second suspension eye to be congruently placed on the side of the lining plate opposite the suspension eye. However, the oppositely located eyes can also be arranged in the plate surface independently of each other—always at a distance apart from the hollow profiles—.

An attachment point in the lining plate, which can be engaged and securely held by the lifting means of the crane, does not touch the hollow profile frame and therefore does not impair its buckling resistance, is created by the invention. In spite of the large distance of each suspension eye from the plate edge caused by the width of the hollow profile, the lifting means of the crane can take a secure hold directly in the suspension eye, because there an attachment means is provided which is specially matched to the respectively intended lifting means of the crane.

In accordance with a further development of the invention, the attachment means can be provided in the form of an eye which is pivotably seated around a shaft extending parallel with the plate surface. The eye can be designed symmetrically or asymmetrically in respect to the shaft. In the latter case in particular, the eye can be shaped in such a way that in one pivot position it projects beyond the adjoining exterior surface of the sheet metal cover of the plate. In that case the lifting means of the crane can be engaged on the outside of the lining plate. The pivotability of the eye possibly has the simultaneous advantage that the eye can be sunk into the suspension eye by folding it. The asymmetrical eyes are preferably used in the suspension eyes which are open on one side. The "symmetrical" eyes are preferably used in the suspension eyes embodied as a continuous opening, which in every pivoted position (around their shaft) lie completely inside the plate body and therefore do not constitute an obstacle in the plate surface.

Steel rods or bolts can also be provided as fastening means in place of the fixed or movable eyes. The rods can lie in the center plane of the plate, but also more in the plane of the sheet metal covers. As a further alternative it is also possible to weld a disk, which extends approximately vertically in respect to the plane of the plate and has at least one opening, for example for suspending a crane hook, into the suspension eye as the fastening means.

Suspension eyes in accordance with the invention with fastening or attachment means fixedly or movably seated therein for crane eyes, cables or the like, can be provided either in the upper area of the lining plate, adjoining the hollow profile frame member there, as well as in the lower area of the lining plate, adjoining the hollow profile with a triangular cross section. If a pair of suspension eyes is present in the upper third of the plate surface and a pair of suspension eyes in the lower third of the plate surface, each a distance apart from the circumferentially provided hollow profile, the lining plate can be lifted by means of a four point suspension and can be brought into a defined horizontal position by the crane, particularly when assembling a lining box. The suspension eyes and the fastening means installed in them can be embodied as steel-cast, welded or forged elements. The suspension eye should be given a rigid frame so that as a whole it also does not impair the rigidity of the plate surface enclosed by the hollow profile frame.

It should be pointed out that a lining plate of the type described often has a cutting edge on the lower edge, but that the invention also relates to a lining plate without such a cutting edge. So-called raised plates are among these which, if a particularly deep trench is to be excavated, are "built up" on a lining plate (with a cutting edge) which had been driven into the ground. Finally, plates used in sliding rail lining often also do not have cutting edges at the lower edge. However, in all cases the lining plate should have a circumferential hollow profile frame, which therefore can have a square or rectangular profile everywhere, as required.

Figure 1:
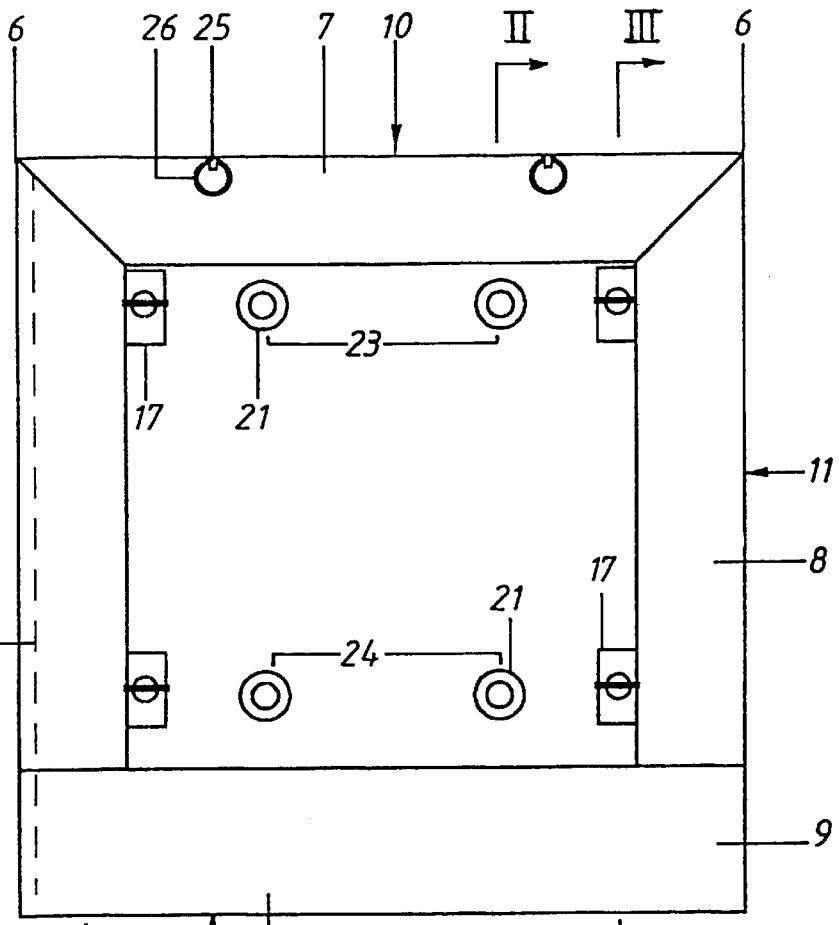
Figure 2:
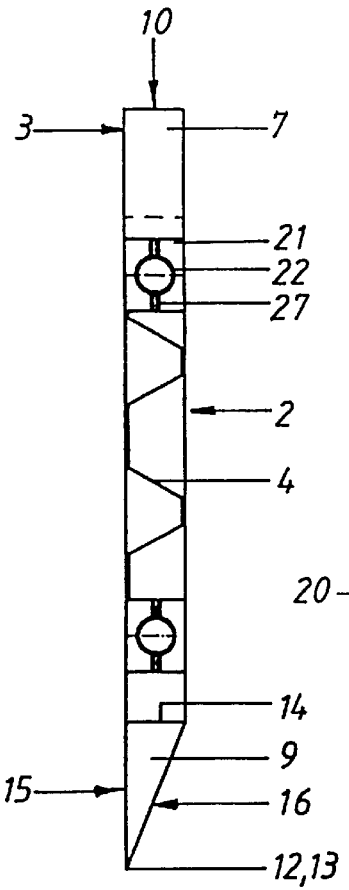

Details of the invention will be explained by means of the schematic representation of exemplary embodiments. Shown are in:

FIG. 1, a view of the inside (side facing inside the trench) of a lining plate;

FIG. 2, a section along the line II—II in FIG. 1;

FIG. 3, a cross section through a lining box, approximately corresponding to the section III—III in FIG. 1; and FIGS. 4 to 8, exemplary embodiments of suspension eyes.

The lining plate represented in FIGS. 1 to 3, identified as a whole by 1, consists of two rectangular cover surfaces 2 and 3 with profiled sheet metal elements 4 enclosed between them and a circumferential hollow profile edge 5 welded to the sheet metal covers 2 and 3, which as a whole is identified as the rectangular frame structure 5 and consists of respectively one hollow profile 7, 8 or 9 uninterruptedly extending from frame corner 6 to frame corner 6. The ends of the cross beams or hollow profiles 7, 8 and 9 meeting at the frame corners 6 are welded together in such a way that the rectangular frame construction 5 acts as one piece. The hollow profiles 7 to 9 can be longitudinally welded or seamlessly welded or drawn. Preferably these are not only U- or C-profiles, but hollow profiles closed in a tube-like manner.

In detail the frame structure 5 in accordance with FIGS. 1 to 3 consists of a pressure cross beam 7 particularly stabilized against flexural buckling at the upper plate edge 10, of respectively one vertical cross beam 8 especially stabilized against forces in the vertical longitudinal direction at the plate side edges 11, and a pointed hollow profile 9 having a cutting edge 12 on the lower plate edge 13. While the pressure cross beam 7 and the vertical cross beam 8 are intended to have a rectangular cross section, their long side of the rectangle preferably being parallel with the adjoining sheet metal cover 2, 3, the pointed hollow profile has a cross section at the lower edge 13 in the approximately form of a right triangle, whose one cathetus 14 lies vertically in respect to the plane of the adjoining sheet metal covers 2, 3, whose other cathetus 15 lies in the plane of the exterior sheet metal cover 3 which, during lining, faces the soil, and whose hypotenuse 16 is intended to face the interior of the trench.

Receptacle housings 17 provided for placing and fastening braces in place are inserted with the opening at the sheet metal cover 2, which is on the inside during lining, into the lining plate 1 adjoining or adjacent to the hollow profiles—preferably 7 and 8, without any weakening, in particular a recess, being required at the profile cross beams. Of course the receptacle housings 17 are only strictly required if the lining plate 1 is used in a lining box (complemented into a lining box 18 with braces 19 in accordance with FIG. 3, which extend from the receptacle housing 17 to the receptacle housing of the lining plates placed opposite the trench), but in slide rail lining, if necessary with T-rails 20, welded to or formed along the vertical hollow profile 8, approximately along the dashed line.

If a lining box 18, shown in section in FIG. 3, is intended to be assembled with the aid of a lining box 1, first a lining plate 1 is placed on the ground, then the braces 19 are installed in the receptacle housing 17 of the lining plate on the ground, subsequently the second lining plate is positioned above the first lining plate by means of a crane in such a way that the braces 19 are also inserted into the receptacle housings 17 of that plate and fixed in place there. In order to be able to safely direct and lift the lining plate, several preferred possibilities for fastening the lifting means of the crane are provided in the exemplary embodiment.

The essential fastening means created by the invention is the suspension eye 21 embedded into the plate surface a distance apart from the circumferential hollow profiles 7 to 9, which contains a fastening means 22 as attachment point for a lifting means of the crane and therefore can hold a crane hook, a cable hanging from the crane or the like, securely fixed in place. For example, in accordance with FIGS. 1 and 2 it is provided to arrange respectively one pair of suspension eyes 23 and 24 in the upper third and in the lower third of the lining plate ((each a distance apart from the circumferentially provided hollow profile 7 to 9). When a lining plate 1 is suspended at the points defined by the two pairs of suspension eyes 23 and 24, it can be arbitrarily directed horizontally.

It is also within the scope of the invention to provide only one suspension eye 21 or only one pair of suspension eyes 23 or 24 in the longitudinal surface of the plate. For example, only the pair of suspension eyes 23 adjoining the upper hollow profile 7 can be provided, if the purpose is to lift or lower the lining plate vertically or pull it along the trench at these suspension eyes 21 or 23. Alternatively it is also possible to provide only the pair of suspension eyes 24 adjacent to the lower hollow profile 9, and to use it in combination with a pull ring 26 welded directly outside to the upper hollow profile 7 via eyes 25. If necessary, the pull rings 26 should be welded to the upper hollow profile in such a way, that its resistance against flexural buckling is not impaired. Finally it is also possible to use the upper pair of suspension eyes 23 in combination with hooks hung over the cutting edge 12 for lifting the plate.

Figure 4:
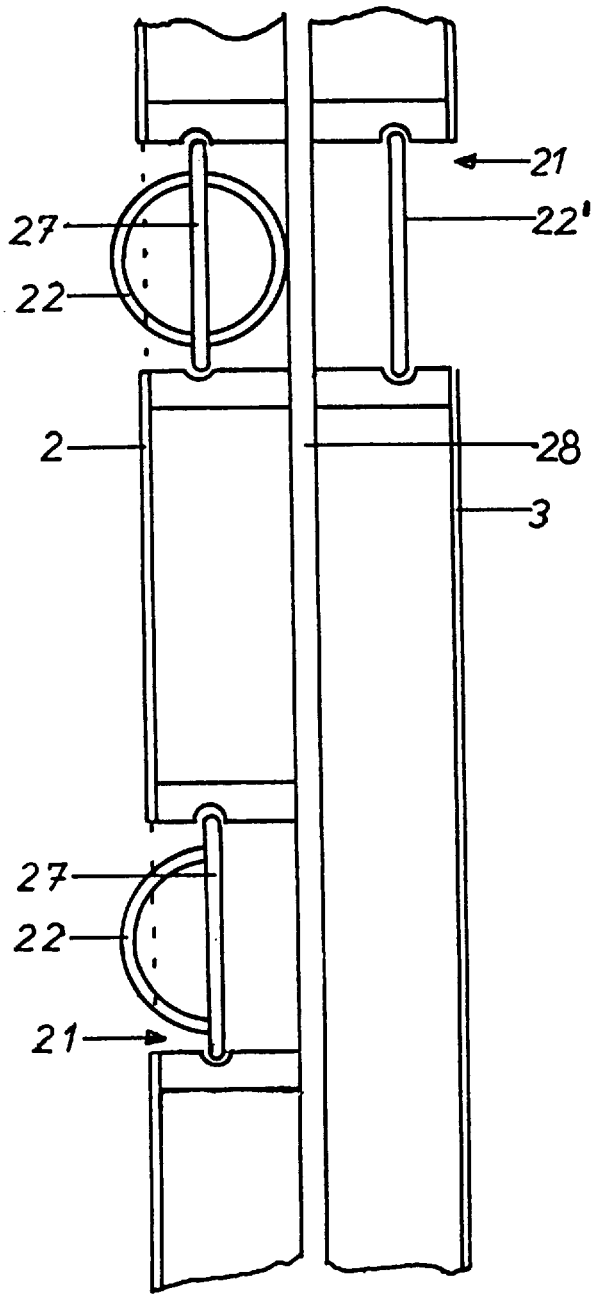
Figure 5:
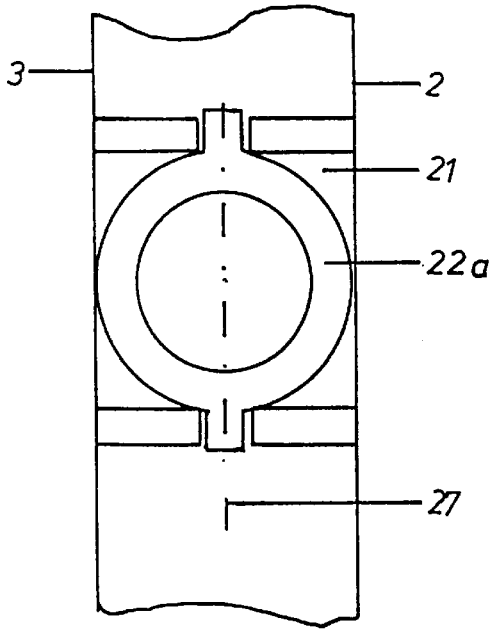

The suspension eyes 21 in accordance with the invention can be embodied in accordance with FIGS. 2 and 4 in different forms. FIG. 2 shows eyes 21 extending through the lining plate 1, in which the respective fastening means, for example a bolt or an eye 22 pivotable around a shaft 27, are seated. Alternatively to this it is also possible in accordance with FIG. 4 to provide that the single suspension eye 21 extends on one side only as far as an inner wall 28. Two further alternatives result from this, namely that two suspension eyes 21 are placed congruently directly opposite each other (see the upper embodiment of FIG. 4), or that two suspension eyes 21 provided on different surfaces 2, 3 of the lining plate 1 are distributed in the respective surface independently of each other (see the lower alternative of FIG. 4).

In particular if, in the exemplary embodiment in accordance with FIG. 4 as well as in the exemplary embodiment in accordance with FIG. 2, a fastening means 22 is desired, which is pivotable in the suspension eye 21, it can be sensible to embody the fastening means asymmetrical in respect to the associated shaft 27, so that pivoting of the eye 22 out of the cover surface 2, 3 of the lining plate 1 is possible in regard to space. Here, the same as in the other exemplary embodiments, the fastening means 22 can also be simply designed as a bolt 22' extending parallel with the cover surface 2, 3. Each suspension eye 21 can have a massive frame 29.

Exemplary embodiments of fastening means in suspension eyes penetrating through the hollow plate are represented in FIGS. 5 to 8. The exemplary embodiments correspondingly apply if the suspension eyes in accordance with FIG. 4 only partially penetrate the plate.

Figure 6:
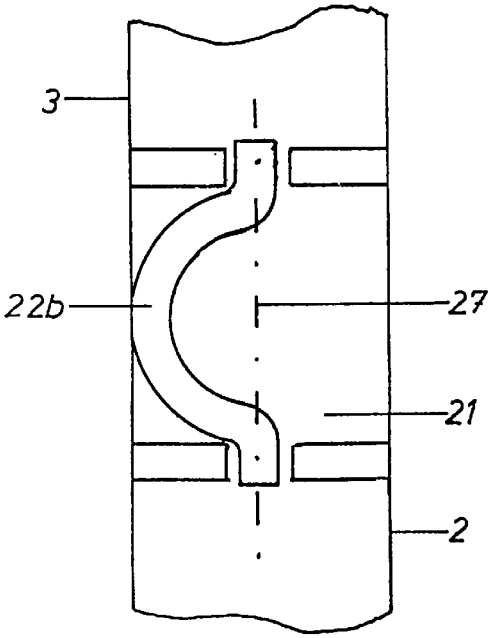
Figure 8:
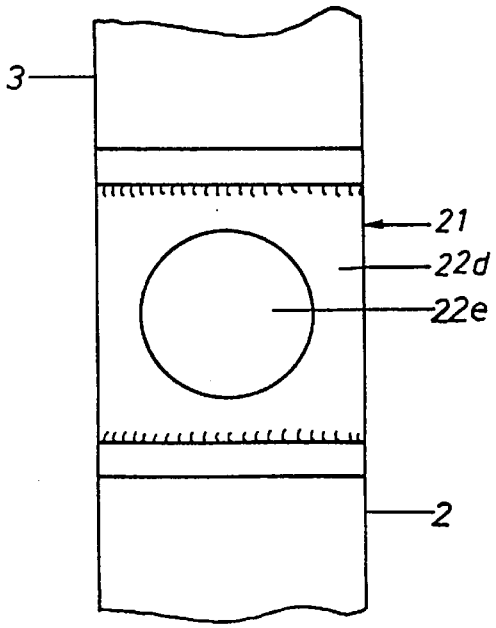

Plate 5 shows a suspension eye 21 with a ring-shaped fastening means 22 a in accordance with FIG. 2, which is seated, pivotable around a shaft 27, parallel with the plate surface 2. The exemplary embodiment in accordance with FIG. 6 shows a fastening means 22 b, that only consists of a half ring, so to speak, which is also seated, pivotable around a shaft 27, in the suspension eye 21.

Figure 7:
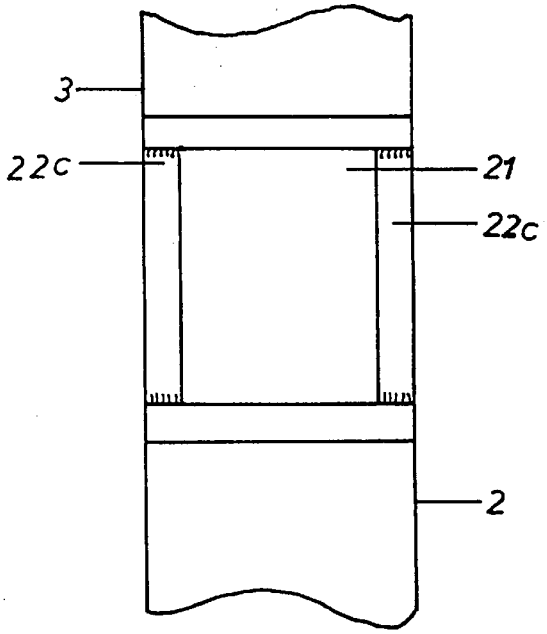

The exemplary embodiment in accordance with FIG. 7 shows two fastening means 22*c* extending approximately radially in the suspension eye 21, which are embodied as bolts or steel rods. The rods 22*c* of the exemplary embodiment can be disposed in the plane of the cover surfaces 2 and 3 or anyplace else inside the suspension eye 21. As it were, each one of the rods 22*c* constitutes a spoke in the suspension eye 21. In the exemplary embodiment in accordance with FIG. 8 a fastening means 22*d* is provided in the suspension eye 21, which is embodied as a disk located vertically in respect to the plate plane. The disk has at least one hole 22*e*, in which a crane hook is intended to be suspended. The disk 22*d*, the same as the bolts 22*c* of FIG. 7, extend approximately radially in the suspension eye 21.

What is claimed is:

1. A lining plate (1), consisting of profiled sheet metal elements (4) enclosed between two rectangular sheet metal covers (2, 3) and hollow profiles (7 to 9) welded together with the sheet metal covers to form a frame structure made of circumferential closed hollow profiles for use in connection with trench lining in below-grade construction, the lining plate comprising a plate surface and including a suspension eye (21) cut into the plate surface a distance apart from the circumferential hollow profiles, which can be gripped by lifting means of a crane, the suspension eve including a separate fastening means (22) as the attachment point for the lifting means of the crane.

2. The lining plate in accordance with claim 1, wherein the fastening means comprises a shaft (27) extending parallel with the plate surface and a fastening eye (22) pivotable around the shaft, the fastening eye being symmetrically or asymmetrically shaped in respect to the shaft (27).

3. The lining plate in accordance with claim 1, wherein the fastening means comprises at least one bolt (22*c*), welded into the suspension eye (21) and extending radially therein.

4. The lining plate in accordance with claim 1, wherein the fastening means comprises a disk (22*d*) extending vertically in respect to the plate surface and being welded into the suspension eye, the disk including at least one opening (22*e*) adapted for engaging a crane hook.

5. The lining plate in accordance with claim 1, wherein the fastening means (22) in the suspension eye (21) is made of cast steel, welded steel or forged steel.

6. The lining plate in accordance with claim 1, wherein the suspension eye (21) is provided in the plate surface being a distance apart from the circumferential hollow profile (7 to 9).

7. The lining plate in accordance with claim 6, wherein a pair of suspension eyes (23) is provided in the upper third of the plate surface.

8. The lining plate in accordance with claim 6, herein a pair of suspension eyes (23) is provided in the upper third of the plate surface and a pair of suspension eyes (24) is provided in the lower third of the plate, each respectively a distance apart from the circumferential hollow profile (7 to 9).

9. The lining plate in accordance with claim 6, wherein a pair of suspension eyes (24) is provided in the lower third of the plate, each respectively a distance apart from the circumferential hollow profile (7 to 9).

10. The lining plate in accordance with claim 1, wherein the suspension eye (21) has a frame (29) made of cast steel, welded steel or forged steel.

11. The lining plate in accordance with claim 1, wherein the fastening means (22) is immovably seated in the suspension eye (21).

12. A lining plate (1), comprising of profiled sheet metal elements (4) enclosed between two rectangular sheet metal covers (2, 3) and hollow profiles (7 to 9) welded together with the sheet metal covers to form a frame structure made of circumferential closed hollow profiles for use in connection with trench lining in below-grade construction, the lining plate comprising a plate surface and including a suspension eye (21) cut into the plate surface a distance apart from the circumferential hollow profiles, which can be gripped by lifting means of a crane, the suspension eye including a separate fastening means (22) as the attachment point for the lifting means of the crane, the fastening means comprising a shaft (27) extending parallel with the plate surface and a fastening eye (22) pivotable around the shaft, the fastening eye being symmetrically or asymmetrically shaped in respect to the shaft (27).

13. The lining plate in accordance with claim 12, wherein the suspension eye (21) has a frame (29) made of cast steel, welded steel or forged steel.

14. A lining plate (1), comprising of profiled sheet metal elements (4) enclosed between two rectangular sheet metal covers (2, 3) and hollow profiles (7 to 9) welded together with the sheet metal covers to form a frame structure made of circumferential closed hollow profiles for use in connection with trench lining in below-grade construction, the lining plate comprising a plate surface and including a suspension eye (21) cut into the plate surface a distance apart from the circumferential hollow profiles, which can be gripped by lifting means of a crane, the suspension eye including a separate fastening means (22) as the attachment point for the lifting means of the crane, the fastening means comprising at least one bolt (22*c*), welded into the suspension eye (21) and extending radially therein.

15. The lining plate in accordance with claim 14, wherein the fastening means is immovably seated in the suspension eye (21).

16. The lining plate in accordance with claim 14, wherein the suspension eye (21) has a frame (29) made of cast steel, welded steel or forged steel.

* * * * *